US006471794B2

(12) United States Patent
Doko et al.

(10) Patent No.: US 6,471,794 B2
(45) Date of Patent: Oct. 29, 2002

(54) FIN MATERIAL FOR BRAZING

(75) Inventors: Takeyoshi Doko, Tokyo (JP); Akira Kawahara, Tokyo (JP); Sunao Fukuda, Kariya (JP); Yoshihiko Kamiya, Kariya (JP); Masaki Shimizu, Kariya (JP); Kenji Negura, Kariya (JP)

(73) Assignees: The Furukawa Electric Co., Ltd., Tokyo (JP); Denso Corporation, Kariya (JP)

( * ) Notice: Subject to any disclaimer, the term of this patent is extended or adjusted under 35 U.S.C. 154(b) by 0 days.

(21) Appl. No.: 09/861,141

(22) Filed: May 18, 2001

(65) Prior Publication Data

US 2002/0000270 A1 Jan. 3, 2002

(30) Foreign Application Priority Data

May 19, 2000 (JP) ..... 2000-148775

(51) Int. Cl.[7] ..... C22C 21/00

(52) U.S. Cl. ..... 148/437; 148/438; 420/550; 420/551; 420/538; 420/540; 420/541

(58) Field of Search ..... 148/415, 416, 148/437, 438; 420/537, 538, 540, 541, 550, 551

(56) References Cited

U.S. PATENT DOCUMENTS 4,126,487 A * 11/1978 Morris et al. ..... 148/2

5,489,347 A * 2/1996 Himuro et al. ..... 148/437

FOREIGN PATENT DOCUMENTS

| | | |
|---|---|---|
| EP | 0 637 481 A1 | 2/1995 |
| JP | 07-216485 | 8/1995 |
| JP | 08-104934 | 4/1996 |
| JP | 09157807 | 6/1997 |
| JP | 11-131166 | 5/1999 |

* cited by examiner

*Primary Examiner*—George Wyszomierski
*Assistant Examiner*—Janelle Combs Morillo
(74) *Attorney, Agent, or Firm*—Knobbe Martens Olson & Bear LLP

(57) ABSTRACT

An aluminum alloy fin material for brazing which is composed of an aluminum alloy comprising above 0.1 wt % to 3 wt % of Ni, above 1.5 wt % to 2.2 wt % of Fe, and 1.2 wt % or less of Si, and at least one selected from the group consisting of 4 wt % or less of Zn, 0.3 wt % or less of In, and 0.3 wt % or less of Sn, and further comprising, optionally, at least one selected from the group consisting of co, Cr, Zr, Ti, Cu, Mn, and Mg in given amounts, the balance being unavoidable impurities and aluminum, wherein a ratio of the grain length in the right angle direction/the grain length in the parallel direction is 1/30 or less, an electric conductivity is 50 to 55 %IACS, and a tensile strength is 170 to 280 MPa.

11 Claims, 1 Drawing Sheet

FIN MATERIAL FOR BRAZING

FIELD OF THE INVENTION

The present invention relates to an Al—Ni—Fe alloy fin material for brazing that has excellent corrosion resistance, mechanical strength, and heat conductivity.

BACKGROUND

The majority of automotive heat exchangers is composed of Al and Al alloys, and is manufactured by brazing. Usually, a brazing material of Al—Si series is used for brazing, so that the brazing is carried out at a temperature as high as 600 °C. As shown in FIG. 1, for example, a heat exchanger, such as a radiator, has thin wall fins (2) machined in a corrugated form among plural flattened tubes (1) integrally built. Both ends of the flattened tubes (1) are opened respectively to a space formed by a header (3) and a tank (4), so that a high temperature refrigerant is transmitted from a space of the tank on one side through the flattened tubes (1) to a space of the tank (4) on the other side, thereby effecting heat exchange in a portion of the tubes (1) and the fins (2) and again circulating the resultant low temperature refrigerant.

In recent years, heat exchangers gradually become light-weight and smaller in size, thus necessitating enhancement of heat efficiency of the heat exchangers while enhancement of heat conductivity of the materials is desired. Especially, enhancement in heat conductivity of the fin materials is now being discussed and as a result a fin material of an alloy is proposed as a thermally conductive fin wherein the alloy composition are approached to pure aluminum. However, in case a fin is processed to a thin wall one, there arises a problem that the fin will be collapsed on assembling a heat exchanger or destroyed during the use as a heat exchanger, if the mechanical strength of fin is not sufficient. In case of a fin made of pure aluminum series alloy, the fin has a defect of lacking mechanical strength, so that addition of an alloying element such as Mn is effective for enhancing strength. Due to brazing heated up to about 600 °C. in the course of manufacturing a heat exchanger, however, there may be a problem that any element added to the alloy for enhancing mechanical strength will again become solid solution on heating for brazing to deteriorate promotion of heat conductivity.

As a fin material dissolving these problems, an Al—Si—Fe alloy to which Ni or Co has been added is proposed, which shows characteristics of excellent mechanical strength and heat conductivity (JP-A-7-216485 ("JP-A" means unexamined published Japanese patent application), JP-A-8-104934, etc.).

Among these fin materials, however, an aluminum alloy to which Fe exceeding 1.5% (% means wt %; the same will be applied hereinafter) has been added together with Ni permits generation of Al—Fe—Ni series intermetallic compounds inside the fin material, these metals cause enhancement of mechanical strength and heat conductivity, but such the problem occurs that they also cause lowering corrosion resistance of the fin material itself. The fin material serves as a sacrificial corrosion-preventive material to protect tubes. However, if the corrosion resistance of the fin material itself is too low, the fin will be consumed in the early stages due to corrosion, failing to protect the tube for a long period of time.

SUMMARY

The present invention is an aluminum alloy fin material for brazing which is composed of an aluminum alloy comprising more than 0.1 wt % but 3 wt % or less of Ni, more than 1.5 wt % but 2.2 wt % or less of Fe, and 1.2 wt % or less of Si, and at least one selected from the group consisting of 4 wt % or less of Zn, 0.3 wt % or less: of In, and 0.3 wt % or less of Sn, and further comprising, optionally, at least one selected from the group consisting of 3.0 wt % or less of Co, 0.3 wt % or less of Cr, 0.3 wt % or less of Zr, 0.3 wt % or less of Ti, 1 wt % or less of Cu, 0.3 wt % or less of Mn, and 1 wt % or less of Mg, and any unavoidable impurities with the balance being aluminum, wherein a ratio of a length in right angle direction to the rolling direction of an individual grain viewed from the sheet surface to a length of the grain in the parallel direction to the rolling direction (the grain length in the right angle direction/the grain length in the parallel directiØn) is 1/30 or less, an electric conductivity is 50% IACS or more but 55%IACS or less, and a tensile strength is 170 MPa or more but 280 MPa or less.

Other and further features, and advantages of the invention will appear more fully from the following description, take in connection with the accompanying drawing.

DETAILED DESCRIPTION

Figure 1:
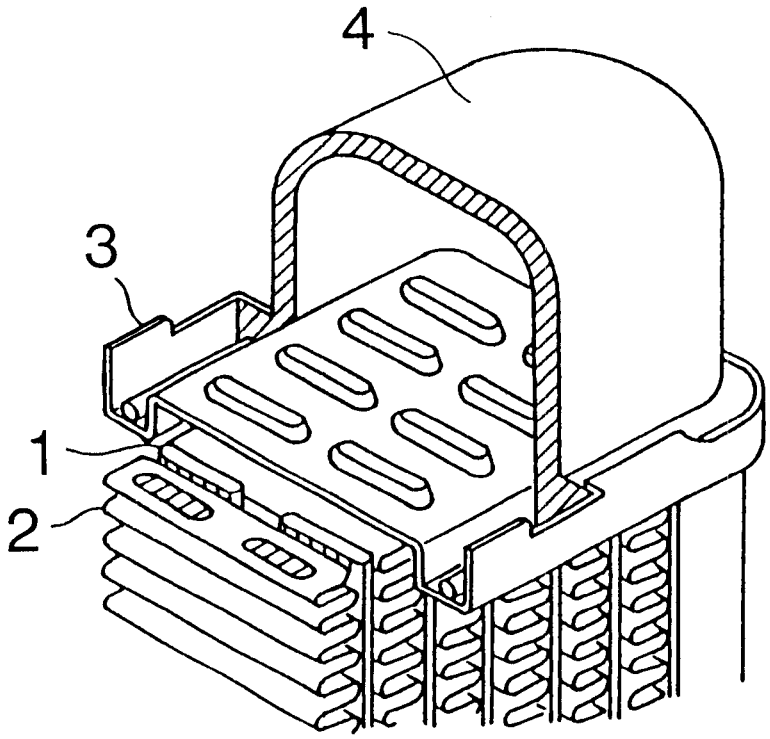
FIG. 1 is a schematic view showing a radiator.

One of the characteristics of the present invention resides in enhancing corrosion resistance of the fin material itself, by using an alloy known to be excellent in mechanical strength and electric conductivity after brazing, thereby controlling the metal structure. Prior to describing control of the metal structure, alloying elements for which the present invention sets a target will be explained hereinafter.

In the present invention, more than 0.1 wt % but 3 wt % or less of Ni and more than 1.5 wt % but 2.2 wt % or less of Fe are contained to solve the problem of the fin material by adding Fe and Ni to enhance mechanical strength and heat conductivity after brazing. Especially, the reason why the alloy is limited to contain more than 1.5 wt % of Fe, is due to the fact that if it is 1.5 wt % or less, reduction in corrosion resistance of the fin itself is so small that it is unnecessary to control the metal structure in the present invention. Further, the reason why the upper limit of Fe is 2.2 wt %, is due to the fact that corrosion resistance of the fin material can no longer be improved even according to the present invention if Fe exceeds the upper limit. The lower limit of Ni is determined according to the amount for enhancing mechanical strength and electric conductivity in the coexistence of Fe. The upper limit of Ni is determined, likewise in case of Fe, due to the reason that corrosion resistance of the fin material can no longer be improved even according to the present invention.

In view of the foregoing, the amounts of Ni and Fe to be added are determined, but 0.6 wt % or more of Ni, especially 0.9 wt % or more is recommended to ensure high mechanical strength. In the production of the fin material of the present invention according to a continuous casting, it is recommendable to use 2 wt % or less of Ni for ensuring stability. Besides this, 2.0 wt % or less of Fe is especially recommendable for enhancing stability on the continuous casting and enhancing corrosion resistance of the fin material.

In addition to the aforesaid Ni and Fe, the alloy may contain at least one selected from the group consisting of 1.2 wt % or less of Si, 3.0 wt % or less of Co, 0.3 wt % or less of Cr, 0.3 wt % or less of Zr, 0.3 wt % or less of Ti, 4 wt % or less of Zn, 0.3 wt % or less of In, 0.3 wt % or less of Sn, 1 wt % or less of Cu, 0.3 wt % or less of Mn, and 1 wt % or less of Mg and unavoidable impurities. In the present invention, in addition to the aforesaid Ni and Fe, preferably the alloy contains 1.2 wt % or less of Si, and at least one selected from the group consisting of 4 wt % or less of Zn, 0.3 wt % or less of In, and 0.3 wt % or less of Sn, and further comprising, optionally, at least one selected from the group consisting of 3.0 wt % or less of Co, 0.3 wt % or less of Cr, 0.3 wt % or less of Zr, 0.3 wt % or less of Ti, 1 wt % or less of Cu, 0.3 wt % or less of Mn, and 1 wt % or less of Mg, and any unavoidable impurities with the balance being aluminum. These elements play an important role in characteristics when the alloy is processed to the fin material. Stated below are effects and the reasons for limitation of the individual elements.

Si improves mechanical strength by its addition. Si itself becomes solid solution and is hardened to enhance mechanical strength and moreover exhibits promotion of precipitation of Fe, Ni and Co when these elements are coexistent. In the fin material of the present invention, it is important that an intermetallic compound of Al—Fe series is not coarsely enlarged. Addition of Si easily tends to precipitate intermetallic compounds so that a lot of intermetallic compounds are actually precipitated with the result that magnitude of individual intermetallic compounds becomes smaller as compared with the case wherein Si is not added. Such promotion effect of precipitation may not be sufficient in case Si is 0.3 wt % or less, whereas the fin will be molten at the time of brazing when addition exceeds 1.2 wt %. Accordingly, the amount of Si in case of adding to the alloy 1.2 wt % or less, preferably exceeds 0.03 wt % but 1.2 wt % or less, but the precipitation-promoting effect becomes significant if Si is 0.3 wt % or more. On the other hand, if the amount of Si is too excessive, the solid-solute Si causes deterioration of heat conductivity of the fin. Thus, 0.8 wt % or less is preferable. Among these ranges of 0.3 to 0.8 wt %, stable characteristics are especially shown by the range of 0.4 to 0.7 wt %.

Co exhibits a similar effect to Ni. In case Co is added to the alloy, therefore, the amount is 3.0 wt % or less, preferably more than 0.1 wt % but 3.0 wt % or less, in particular the range of 0.3 wt % to 2 wt % showing an excellent characteristics. As compared with Ni, however, Co is somewhat inferior in heat conductivity and weak in the effect of dividing a compound of Al-Fe series. Further, Co is more expensive than Ni. In. the present invention, it is possible to use Co in place of Ni or add Co concurrently with Ni, but addition of Ni is recommendable herein due to the reason that addition of Ni alone is more significant in characteristics and cost. The lower limit of the amount of Co to be added is generally 0.1 wt % in case of a single addition but may be minimized when added in combination with Ni.

Addition of 0.3 wt % or less of Zr and Cr each serves to enhance mechanical strength, while Zr is added to make recrystallized grain of the fin material coarse, which are formed at the time of brazing, so as to prevent drooping of the fin and diffusion of a solder in the fin. In case of carrying out continuous casting, however, an alloy to which Zr and Cr have been added may cause clogging of a nozzle to make casting impossible. Accordingly, it is preferable that Zr and Cr are not added to the alloy and it is recommended that each amount of these metals is 0.08 wt % or less even if these metals are added. 0.3 wt % or less of Ti is added to enhance mechanical strength as a prime object. In case continuous casting is carried out, however, an alloy to which Ti has been added may cause clogging of a nozzle to make casting impossible. Accordingly, it is preferable that Ti is not added to the alloy and it is recommended that the amount of Ti is 0.08 wt % or less even if Ti is added. Further, Ti may be added for the purpose of making the cast-ingot structure fine, but 0.02 wt % or less of Ti is sufficient enough to attain the purpose. 4 wt % or less of Zr, 0.3 wt % or less of In, and 0.3 wt % or less of Sn are added to impart sacrificial corrosion-preventing effect to the fin material. The amount and the sort of elements may be determined depending on the corrosion-preventing characteristics and heat conductivity demanded for the fin material. In and Sn exhibit satisfactory sacrificial effect, but these elements are expensive and there may be a problem of impossibility of recycling a waste alloy scrap to other alloy material. In the present invention, therefore, addition of Zn is specially recommended. As Zn deteriorates corrosiveness of the fin itself by increasing the amount added, it is recommended to add at 2 wt % or less, especially at 1 wt % or less. The lower limit of the amount may be determined according to the alloy materials used, but generally it is preferable to add 0.3 wt % or more.

In the present invention, there may be the case wherein Cu is further added. Cu is added chiefly for enhancing mechanical strength. If added, it may be 0.05 wt % or less, but it is not effective to enhance mechanical strength. On the other hand, if the amount is increased, the degree of decreasing sacrificial anode effect becomes stronger so that amount is recommended to 1 wt % or less, especially 0.3 wt % or less. As Cu functions to make the potential of the fin material noble thereby decreases the sacrificial anode effect. Cu, if added, has to be added together with either of the elements, Zn, In, and Sn.

Mn may be added to increase mechanical strength but may deteriorate heat conductivity with the addition of only a slight amount. Accordingly, the amount of Mn is limited to 0.3 wt % or less, but it is preferable to add nothing.

Mg may also be added to increase mechanical strength but it reacts with flux in NB brazing to deteriorate brazability so that Mg must not be added in case of using the fin material for NB brazing. In case the fin material is used for vacuum brazing, 1 wt % or less of Mg should be added, but it is recommended not to add since Mg is evaporated during the brazing and its effect is small.

Among the aforesaid unavoidable impurities and elements to be added for the reason other than the above in the present invention, B or the like may be mentioned which is added together with Ti for making the cast-ingot structure fine. No problem arises in the event these elements may be contained if they are respectively 0.03 wt % or less.

It is one of the characteristics of the present invention that a ratio of a length in right angle direction to the rolling direction of an individual grain viewed from the plate surface to a length of the grain in the parallel direction to the rolling direction (the grain length in the right angle direction/the grain length in the parallel direction) is 1/30 or less, an electric conductivity is 50%IACS or more but 55%IACS or less, and a tensile strength is 170 MPa or more but 280 MPa or less.

At the outset, an explanation is given hereunder on the grain diameter viewed from the sheet surface.

In general, the fin material is subjected on the way to annealing and then to cold rolling to have a given thickness. A grain diameter of the fin material prior to brazing is determined by the grain diameter after annealing and the subsequent cold rolling. It is generally that the final cold rolling rate of the fin material is 50% or less. Accordingly, a ratio of a length in right angle direction to the rolling direction of an individual grain viewed from the sheet surface of the fin material formed, to a length of the grain in the parallel direction to the rolling direction (the grain length in the right angle direction/the grain length in the parallel direction) is 1/2 or more, provided that an isometric grain diameter is formed by annealing. Even if a ratio of a length in right angle direction to the rolling direction of an individual grain viewed from sheet surface after annealing to a length of the grain in the parallel direction to the rolling direction (the grain length in the right angle direction/the grain length in the parallel direction) is 1/10, the ratio will become 1/20 or more when the fin material is formed. In the present invention, on the other hand, a ratio of a length in right angle direction to the rolling direction of an individual grain viewed from sheet surface of the fin material to a length of the grain in the parallel direction to the rolling direction (the grain length in the right angle direction/the grain length in the parallel direction) is 1/30 or less, so that the grain structure is greatly different from that of the generally fin material. In fact, in order that electric conductivity and mechanical strength of the generally fin material are so modified as to be involved within the scope of the present invention and then fin material thus modified is changed to the fin material with the grain diameter of the present invention, only is the case that a fine precipitate is densely dispersed in the grain, the precipitate serving to form a structure wherein subgrain boundary is pinned up by the precipitate.

In case a ratio of a length in right angle direction to the rolling direction of an individual grain viewed from sheet surface of the fin material to a length of the grain in the parallel direction to the rolling direction (the grain length in the right angle direction/the grain length in the parallel direction) exceeds 1/30, a precipitate in the fin material is comparatively coarse and sparsely dispersed. In the fin material even after brazing, therefore, there remains only coarse precipitate around which points of local cell are formed to shorten anti-corrosive life of the fin material itself. In this case, moreover, the subgrain boundary is not pinned up by the precipitate so that recrystallization promptly proceeds in the course of brazing, thus causing the formation of coarse precipitated grain.

On the other hand, the precipitated grain exists densely in the condition of the present invention that a ratio of a length in right angle direction to the rolling direction of an individual grain viewed from the sheet surface of the fin material to a length of the grain in the parallel direction to the rolling direction (the grain length in the right angle direction/the grain length in the parallel direction) is 1/30 or less. In case brazing is carried out in such state, the precipitated grains are not present in a large amount especially in the recrystallization grain boundary on heating for brazing. As intermetallic compounds large enough to form points of local cell become smaller so that anti-corrosive property of the fine material itself is enhanced. Further, since the subgrain boundary is pinned up by the precipitate, precipitation is promoted at a temperature prior to the brazing temperature of around 500° C. to exhibit an effect that the precipitated grains are finely dispersed. Therefore, the ratio of the grain length in the right angle direction/the grain length in the parallel direction is 1/30 or less, preferably 1/1000 to 1/40, though in the invention it is not limited to this preferable range.

The aforesaid grain diameter is obtained by taking a photograph on observation with the aid of an optical microscope of the fin material after etching or subjecting the photograph directly to an image treatment. If a ratio of the grain length in right angle direction/the grain length in the parallel direction becomes 1/100 or less, a length in the parallel direction to the rolling direction becomes so great that it may be beyond the field of vision. In such case, it is evident that the grain diameter satisfies the present invention. Provided that the value becomes 1/100 or less, it is of no necessity to take a value 1/100 or less into a problem.

The electric conductivity is an index showing an amount of solid solution elements in an aluminum alloy. As the amount of solid solution elements becomes larger, the electric conductivity becomes smaller. In case the electric conductivity is less than 50%IACS, the amounts of Fe and Ni solid dissolved in the fin material are so large that Fe and Ni will be precipitated in a recrystallization grain boundary generated on heating for brazing the fin material. As the amount of a precipitate is increased along the recrystallization grain boundary after brazing, corrosion along the grain boundary becomes significant on corrosion takes place. In the fin material of alloy series, the grain in the direction of thickness is one in the majority of the cases. As corrosion proceeds along the boundary, therefore, the fin will be worn out and collapsed in shreds to shorten the anti-corrosive life of the fin itself prior to corrosion of the whole body of the fin. If the electric conductivity exceeds 55%IACS, the amount of a precipitate in the fin material will be too excessive with the result that the precipitated grain will be again solid dissolved in the course of heating for brazing. In this case, the smaller the grain the easier the re-solid solution, and only coarse grain remain in the fin material after brazing. Thus, points of local cell are formed around the coarse precipitated grain in the fin material after brazing to shorten the anti-corrosive life. Therefore an electric conductivity is 50 to 55%IACS, preferably 52 to 55%IACS, though in the invention it is not limited to this preferable range.

Although the electric conductivity is used for an index of heat conductivity of the fin material, what is a problem is an electric conductivity after brazing. As the heating for brazing is carried out at a temperature of about 600° C., the heating for brazing shows the function of solubilizing treatment so that the amount of solid solution elements (electric conductivity) in the fin material after brazing is determined roughly by the composition of alloy in the fin material. Contrary to this, the electric conductivity before brazing will greatly depend on the heat treatment condition in the course of manufacturing the fin material and has no correlation with the electric conductivity after brazing.

Tensile strength is an index of the amount of dislocation introduced into the fin material. The amount of dislocation is larger as tensile strength becomes stronger. In case tensile strength is less than 170 MPa, the amount of dislocation introduced is too small so that driving power for recrystallization becomes small. On recrystallization during heating for brazing, the grain boundary tends to be pinned up with the precipitated grain, with the result that a lot of the precipitated grains are present in the grain boundary of the fin material after heating for brazing, thus, deteriorating corrosion resistance of the fin material. In case tensile strength exceeds 280 MPa, processing for corrugation is deteriorated to make the fin material for brazing unsuited. Therefore, a tensile strength is 170 to 280 MPa, preferably 180 to 240 MPa, though in the invention it is not limited to this preferable range.

An object of the fin material for brazing of the present invention is achieved by satisfying all factors of the grain diameter, electric conductivity and tensile strength. Even if either one of these factors is out of the conditions, the desired metal structure will not be obtained. What is to be supplemented is that the explanation on the aforesaid reasons for limitations is based on the premise that the other two conditions are involved within the scope of the present invention. In the event the other two conditions overstep the scope of the present invention, a situation different from the above explained will take place.

In order to obtain the grain diameter, electric conductivity, and tensile strength of the present invention, the aforesaid alloy is subjected to operations of a continuous cast-rolling method where a coil is manufactured and then subjected to a cold rolling step where the coil is cold rolled to have a thickness for the fin material. In the course of the operations, an optimum heat treatment is carried out. The continuous cast-rolling method means a method wherein a strip having a thickness of several mm is continuously cast from molten aluminum alloy and a coil is successively manufactured. Hunter method and 3C method are known as typical methods of the continuous cast-rolling method. As compared with the case wherein an ingot is manufactured by DC casting method and is subjected to hot rolling to produce a coil having a wall thickness of several mm, the continuous cast-rolling method wherein a cooling rate during casting is high, makes it possible to crystallize out intermetallic compounds finely at the time of casting. In case of the alloy of the present invention wherein a large amount of Fe is contained, this method is effective for enhancing mechanical strength. As a result of research made by the present inventors, it has been made clear that in comparison with DC method, Fe and Ni are solid dissolved in supersaturated state thereby to enhance corrosion resistance of the fin material itself.

In order to obtain the fin material structure of the present invention, a coil is manufactured by the continuous cast-rolling method and then rolled by the cold rolling step to obtain a fin material having a thickness of 0.10 mm or less. On the way of the operations, at least two times of annealing is carried out at a temperature of 250° C. or higher but 500° C. or lower whereby the second last annealing is carried out with a thickness of 0.4 mm or more but 2 mm or less while the last annealing is carried out under such heating condition that recrystallization is not completed to obtain the structure aimed at. The foregoing is only one example for explaining the fin material of the present invention, and the present invention is not meant to be limited to the above.

In the present invention, the fin material is generally a thin wall material having a thickness 0.1 mm or less. The present invention relates to a brazing sheet fin possessing high mechanical strength and high heat conductivity, and so has no necessity of obtaining a fin material possessing high mechanical strength with a wall thickness exceeding 0.1 mm.

The aluminum alloy fin material for brazing of the present invention can solve problems of alloys known as enhanced in characteristics as a fin material for brazing.

Herein, the term "brazing" is meant NB method, VB method and the like methods known heretofore. The NB method is especially recommended, as the NB method is better in production rate.

The present invention can remarkably enhance corrosion resistance of the fin material itself known as a fin material of Al—Ni—Fe series alloy possessing high mechanical strength and high heat conductivity, thus attaining industrially outstanding effect.

The present invention will be described in more detail based on examples given below, but the present invention is not meant to be limited by these examples.

EXAMPLE

An aluminum alloy having a composition as shown in Table 1 was subjected to continuous cast-rolling to manufacture a coil having a width of 1000 mm and a thickness of 6 mm. The coil was then subjected to cold rolling to manufacture a fin material with a thickness of 0.06 mm, whereby the annealing condition on the way was varied to manufacture fin materials as shown in Table 2. A roll diameter of the continuous cast-rolling machine used was 618 mm. For the purpose of comparison, a coil with a thickness of 6 mm was manufactured by the steps of DC casting, scalping, and hot rolling, and then subjected to cold rolling and annealing to manufacture fin materials as shown in Table 2.

The resultant fin materials were heated for NB brazing at 600° C. for 3 minutes and the tested for 1 week by way of CASS test to investigate for mass loss of the fin materials due to corrosion. The results are shown in Table 3.

TABLE 1

| Alloy No. | Ni | Fe | Si | Co | Cr | Zr | Ti | Zn | In | Sn | Cu | Mn | Mg | Al |
|---|---|---|---|---|---|---|---|---|---|---|---|---|---|---|
| A | 1.1 | 1.7 | 0.5 | — | — | — | — | 0.6 | — | — | — | — | — | Balance |
| B | 1.6 | 1.8 | 0.4 | — | — | 0.04 | 0.05 | 1 | — | — | — | — | — | Balance |
| C | 1.2 | 1.7 | 0.5 | 0.3 | 0.05 | — | — | 0.9 | — | 0.02 | 0.1 | 0.2 | 0.2 | Balance |
| D | 1.4 | 1.8 | 0.5 | — | — | — | 0.05 | 0.5 | 0.04 | — | — | — | — | Balance |
| E | 1.6 | 2.6 | 0.5 | — | — | — | — | 0.6 | — | — | — | — | — | Balance |

wt %

TABLE 2

| | No. | Alloy No. | Method for manufacturing coils before cold-rolling | A ratio of a length in right angle direction to the rolling direction of an individual grain viewed from the sheet surface to a length of the grain in the parallel direction to the rolling direction (the grain length in the right angle direction/the grain length in the parallel direction) | Electric conductivity (% IACS) | Tensile strength (MPa) |
|---|---|---|---|---|---|---|
| Examples of the present invention | 1 | A | Continuous cast-rolling | 1/80 | 53.5 | 195 |
| | 2 | A | Continuous cast-rolling | 1/80 | 52.0 | 210 |

TABLE 2-continued

| | No. | Alloy No. | Method for manufacturing coils before cold-rolling | A ratio of a length in right angle direction to the rolling direction of an individual grain viewed from the sheet surface to a length of the grain in the parallel direction to the rolling direction (the grain length in the right angle direction/the grain length in the parallel direction) | Electric conductivity (% IACS) | Tensile strength (MPa) |
|---|---|---|---|---|---|---|
| | 3 | B | Continuous cast-rolling | 1/100 | 51.5 | 220 |
| | 4 | C | Continuous cast-rolling | 1/40 | 50.5 | 215 |
| | 5 | D | Continuous cast-rolling | 1/70 | 53.0 | 190 |
| Comparative Examples | 6 | A | DC casting · hot rolling | 1/4 | 52.5 | 190 |
| | 7 | A | Continuous cast-rolling | 1/80 | 47.0 | 240 |
| | 8 | B | Continuous cast-rolling | 1/3 | 52.0 | 210 |
| | 9 | C | DC casting hot rolling | 1/40 | 51.0 | 300 |
| | 10 | D | Continuous cast-rolling | 1/4 | 56.5 | 185 |
| | 11 | E | Continuous cast-rolling | 1/100 | 54.5 | 255 |

TABLE 3

| | No. | Result of corrosion test (amount of corrosion mass loss rate %) |
|---|---|---|
| Examples of the present invention | 1 | 9% |
| | 2 | 9% |
| | 3 | 14% |
| | 4 | 12% |
| | 5 | 10% |
| Comparative examples | 6 | 28% |
| | 7 | 24% |
| | 8 | 32% |
| | 9 | 30% |
| | 10 | 25% |
| | 11 | 27% |

The results of the above Tables obviously show that the fin materials of the present invention are extremely small mass loss due to corrosion, thus demonstrating that the corrosion resistance of the fin material itself is excellent.

Having described our invention as related to the present embodiments, it is our intention that the invention not be limited by any of the details of the description, unless other wise specified, but rather be construed broadly within its spirit and scope as set out in the accompanying claim.

What we claim is:

1. An aluminum alloy fin material for brazing which is composed of an aluminum alloy comprising more than 0.1 wt % but 3 wt % or less of Ni, more than 1.5 wt % but 2.2 wt % or less of Fe, and 1.2 wt % or less of Si, and at least one selected from the group consisting of 4 wt % or less of Zn, 0.3 wt % or less of In, and 0.3 wt % or less of Sn, and further comprising, optionally, at least one selected from the group consisting of 3.0 wt % or less of Co, 0.3 wt % or less of Cr, 0.3 wt % or less of Zr, 0.3 wt % or less of Ti, 1 wt % or less of Cu, 0.3 wt % or less of Mn, and 1 wt % or less of Mg, and any unavoidable impurities with the balance being aluminum, wherein a ratio of a length in right angle direction to the rolling direction of an individual grain viewed from the sheet surface to a length of the grain in the parallel direction to the rolling direction (the grain length in the right angle direction/the grain length in the parallel direction) is 1/30 or less, an electric conductivity is 50%IACS or more but 55%IACS or less, and a tensile strength is 170 MPa or more but 280 MPa or less.

2. The aluminum alloy fin material for brazing as claimed in claim 1, wherein the aluminum alloy contains 0.9 wt % or more but 2 wt % or less of Ni.

3. The aluminum alloy fin material for brazing as claimed in claim 1, wherein the aluminum alloy contains more than 1.5 wt % but 2.0 wt % or less of Fe.

4. The aluminum alloy fin material for brazing as claimed in claim 1, wherein the aluminum alloy contains 0.4 to 0.7 wt % of Si.

5. The aluminum alloy fin material for brazing as claimed in claim 1, wherein the aluminum alloy contains 0.3 to 1.0 wt % of Zn.

6. The aluminum alloy fin material for brazing as claimed in claim 1, wherein the aluminum alloy contains 0.3 to 2.0 wt % of Co.

7. The aluminum alloy fin material for brazing as claimed in claim 1, wherein the aluminum alloy contains more than 0.05 wt % but 0.3 wt % or less of Cu.

8. The aluminum alloy fin material for brazing as claimed in claim 1, wherein the ratio of the grain length in the right angle direction/the grain length in the parallel direction is 1/1000 to 1/40.

9. The aluminum alloy fin material for brazing as claimed in claim 1, wherein the electric conductivity is 52 to 55%IACS.

10. The aluminum alloy fin material for brazing as claimed in claim 1, wherein the tensile strength is 180 to 240 MPa.

11. The aluminum alloy fin material for brazing as claimed in claim 1, wherein the aluminum alloy fin material for brazing is obtained by subjecting the alloy to a continuous cast-rolling method and then subjecting the alloy to a cold rolling step.

* * * * *